US008534810B2

(12) United States Patent
Tsubaki

(10) Patent No.: US 8,534,810 B2
(45) Date of Patent: Sep. 17, 2013

(54) LIQUID DISCHARGE HEAD UNIT AND IMAGE FORMING APPARATUS

(75) Inventor: Kengo Tsubaki, Miyagi (JP)

(73) Assignee: Ricoh Company, Ltd., Tokyo (JP)

( * ) Notice: Subject to any disclaimer, the term of this patent is extended or adjusted under 35 U.S.C. 154(b) by 7 days.

(21) Appl. No.: 13/218,998

(22) Filed: Aug. 26, 2011

(65) Prior Publication Data

US 2012/0062659 A1 Mar. 15, 2012

(30) Foreign Application Priority Data

Sep. 10, 2010 (JP) ..... 2010-203360

(51) Int. Cl.
*B41J 2/175* (2006.01)
*B41J 2/17* (2006.01)
*B41J 2/19* (2006.01)

(52) U.S. Cl.
USPC ..... 347/85; 347/84; 347/92; 347/93

(58) Field of Classification Search
USPC ..... 347/84, 85, 92, 93
See application file for complete search history.

(56) References Cited

U.S. PATENT DOCUMENTS

2007/0120913 A1 5/2007 Mukai et al.
2009/0169222 A1 7/2009 Watanabe
2010/0289856 A1 11/2010 Yamamoto et al.
2011/0050814 A1 3/2011 Tsubaki et al.
2011/0181670 A1 7/2011 Tsubaki

FOREIGN PATENT DOCUMENTS

| | | |
|---|---|---|
| JP | 2002-86748 | 3/2002 |
| JP | 2002-144576 | 5/2002 |
| JP | 2007-144732 | 6/2007 |
| JP | 2009-126044 | 6/2009 |
| JP | 2010-131959 | 6/2010 |

*Primary Examiner* — Jannelle M Lebron

(74) *Attorney, Agent, or Firm* — Cooper & Dunham LLP

(57) ABSTRACT

A liquid discharge head unit includes a liquid container tank storing a liquid and a head discharging liquid droplets from its nozzles. The head includes a common channel supplying the liquid to liquid-chambers communicating with the nozzles, and the common channel includes a supply port introducing the liquid and a discharge port discharging the liquid. The liquid container tank includes a container including upstream and downstream chambers separated via a filtering member, a supply path supplying the liquid from the downstream chamber to the supply port of the head, a discharge path discharging the liquid obtained from the discharge port of the head, a communication path via which the downstream chamber communicates with the discharge path, and a communication path via which the upstream chamber communicates with the discharge path, where a fluid resistance of the second communication path is higher than that of the first communication path.

12 Claims, 15 Drawing Sheets

LIQUID DISCHARGE HEAD UNIT AND IMAGE FORMING APPARATUS

BACKGROUND OF THE INVENTION

1. Field of the Invention

The disclosures herein relate to a liquid discharge head unit and an image forming apparatus.

2. Description of the Related Art

An inkjet recording apparatus is generally known as a liquid discharge recording type image forming apparatus, such as a printer, a facsimile machine, or a plotter, or a combination of these functions, that includes a recording head formed, for example, of a liquid discharge head (liquid droplet discharge head) discharging liquid droplets. The liquid discharge recording type image forming apparatus is configured to discharge ink droplets from its recording head onto a transferred sheet, thereby forming an image on the transferred sheet. The formation of the image includes recording, printing, and imaging. There are two types of the liquid discharge image forming apparatus including: 1) a serial type image forming apparatus in which the recording head discharges ink droplets onto the transferred sheet for forming an image while traveling in a main-scanning direction; and 2) a line type image forming apparatus in which the recording head discharges ink droplets onto the transferred sheet for forming an image without traveling in any direction. Note that the transferred sheet is not limited to paper, but may be any media such as an overhead projector (OHP) film insofar as ink droplets or other liquid droplets are adhered to the media. Such media are also referred to as "recording media to be recorded", "recording media", "recording paper", and "recording forms".

Note that in this application, the "liquid discharge recording type image forming apparatus" indicates an image forming apparatus that forms an image onto media such as paper, string, fiber, fabric, leather, metal, plastic, glass, wood, and ceramics by discharging liquid onto such media. Note also that "forming an image" or "image formation" not only indicates providing an image having some kind of meanings onto the media such as characters and symbols, but also indicates an image without having any meanings such as patterns (i.e., by simply discharging ink droplets onto the media). Further, "ink" is not limited to those generally called "ink", but may include those called "liquid" used as a generic name capable of forming an image, such as recording liquid, fixing liquid, and "liquid". The ink of this application also includes a specimens for deoxyribonucleic acid (DNA), resist, patterning material, resin, and the like. Moreover, the "image" is not limited to the image applied to a two-dimensional object, but may include the image applied to a three-dimensional object and to the image formed of a molded object.

In the liquid discharge recording type image forming apparatus, if air bubbles are mixed into the liquid discharge head (i.e., recording head), the liquid discharge head may discharge liquid droplets in wrong directions or may discharge in an inappropriate fashion. Thus, it may be necessary to efficiently eliminate air bubbles present in ink supply paths.

Japanese Patent Application Publication No. 2009-126044 (hereinafter referred to as "Patent Document 1") discloses an example of an air bubble eliminating technology for eliminating air bubbles from a head tank (synonymously used with a "sub-tank" or "buffer tank" insofar as the ink tank is integrally formed in a head). In the air bubble eliminating technology disclosed in Patent Document 1, a recording head is configured to include a first ink chamber having an inflow port to which ink is flown from an ink supply source; a second ink chamber to which ink is supplied from the first ink chamber; a discharge port configured to discharge ink from the second ink chamber, thereby performing a recording operation; a first discharge port configured to discharge a fluid from the first ink chamber; a second discharge port configured to discharge a fluid from the second ink chamber; and a liquid-air separation unit provided between the first ink chamber and the first discharge port, or between the second ink chamber and the second discharge port, and configured to regulate the discharge of the liquid, where a fluid resistance from the inflow port to the first discharge port is lower than resistance from the inflow port to the second discharge port.

Another example of the air bubble eliminating technology for eliminating air bubbles from the head tank is disclosed in Japanese Patent Application Publication No. 2002-086748 (hereinafter referred to as "Patent Document 2"). In the air bubble eliminating technology disclosed in Patent Document 2, a sub-tank is configured to include an ink chamber having an ink introducing part and an ink discharge part, the ink introducing part and the ink discharge part both arranged in an upper part of the ink chamber. The ink chamber includes a supplementary feed valve formed of a compression spring configured to shut off an ink introducing path by closely pressing a ball against a valve seat formed of an elastic member having the ink introducing path provided in the upper part of ink chamber and a sealing part formed of an elastic member having a constantly closed slit in the center of the sealing part provided in the ink discharge part of the ink chamber, where air bubbles mixed inside the ink chamber are appropriately discharged from the slit of the sealing part.

The line type image forming apparatus, for example, includes a recording head unit having liquid discharge head integrally having corresponding heads and tanks for supplying liquids to the heads (i.e., head-tanks) arranged in an entire width direction of a recording medium. In the line type image forming apparatus having such a configuration, ink supplied from main-tanks is distributed in the order of the corresponding sub-tanks and distributors (distributing members) to distribute the ink to the corresponding heads. Note that the head tanks include corresponding filtering members configured to filter impurities from the ink.

However, nozzles provided in each of the heads are extra finely made (e.g., the nozzle diameter of $\phi 24$ μm). Thus, if a dissolved oxygen rate of the ink is high, oxygen is gradually accumulated in the ink, which may eventually cause an ink discharge malfunction. If air bubbles are mixed in the ink within the ink supply path including the head tanks, the ink containing the air bubbles may be distributed without eliminating the air bubbles or the dissolved oxygen rate of the ink may be increased. As a result, the heads may not be able to discharge appropriate amounts of the liquids (ink) or may not be able to discharge the liquids (ink) at all. Accordingly, it may be necessary to eliminate such air bubbles from the ink.

As described above, if the air bubbles are mixed into the liquid (ink) inside the head tanks, the recoding heads may not be able to appropriately discharge the ink, resulting in liquid discharge malfunctioning.

SUMMARY OF THE INVENTION

Accordingly, it is a general object of at least one embodiment of the present invention to provide a liquid discharge head unit and an image forming apparatus having the liquid discharge head unit capable of reducing air bubble being mixed from the head tanks to heads, which substantially eliminate one or more problems caused by the limitations and disadvantages of the related art.

According to one embodiment, there is provided a liquid discharge head unit that includes a liquid container tank configured to store a liquid; and a head configured to receive the liquid from the liquid container tank to discharge liquid droplets therefrom, the head and the liquid container tank being integrally formed. In the liquid discharge head unit, the head includes a common channel configured to supply the liquid to a plurality of liquid chambers communicating with nozzles configured to discharge the liquid droplets, and the common channel includes a supply port configured to introduce the liquid from outside, and a discharge port configured to discharge the introduced liquid outside. In the liquid discharge head unit, the liquid container tank includes a container configured to contain the liquid to be supplied to the head and including an upstream chamber and a downstream chamber separated via a filtering member, a supply path configured to supply the liquid from the downstream chamber of the container to the supply port of the head, a discharge path configured to discharge the liquid discharged from the discharge port of the head, a first communication path via which the downstream chamber communicates with the discharge path, and a second communication path via which the upstream chamber communicates with the discharge path, where a fluid resistance of the second communication path is higher than a fluid resistance of the first communication path.

According to another embodiment, there is provided an image forming apparatus that includes the liquid discharge head unit.

BRIEF DESCRIPTION OF THE DRAWINGS

Other objects and further features of embodiments will be apparent from the following detailed description when read in conjunction with the accompanying drawings, in which.

DESCRIPTION OF THE PREFERRED EMBODIMENTS

Figure 1:
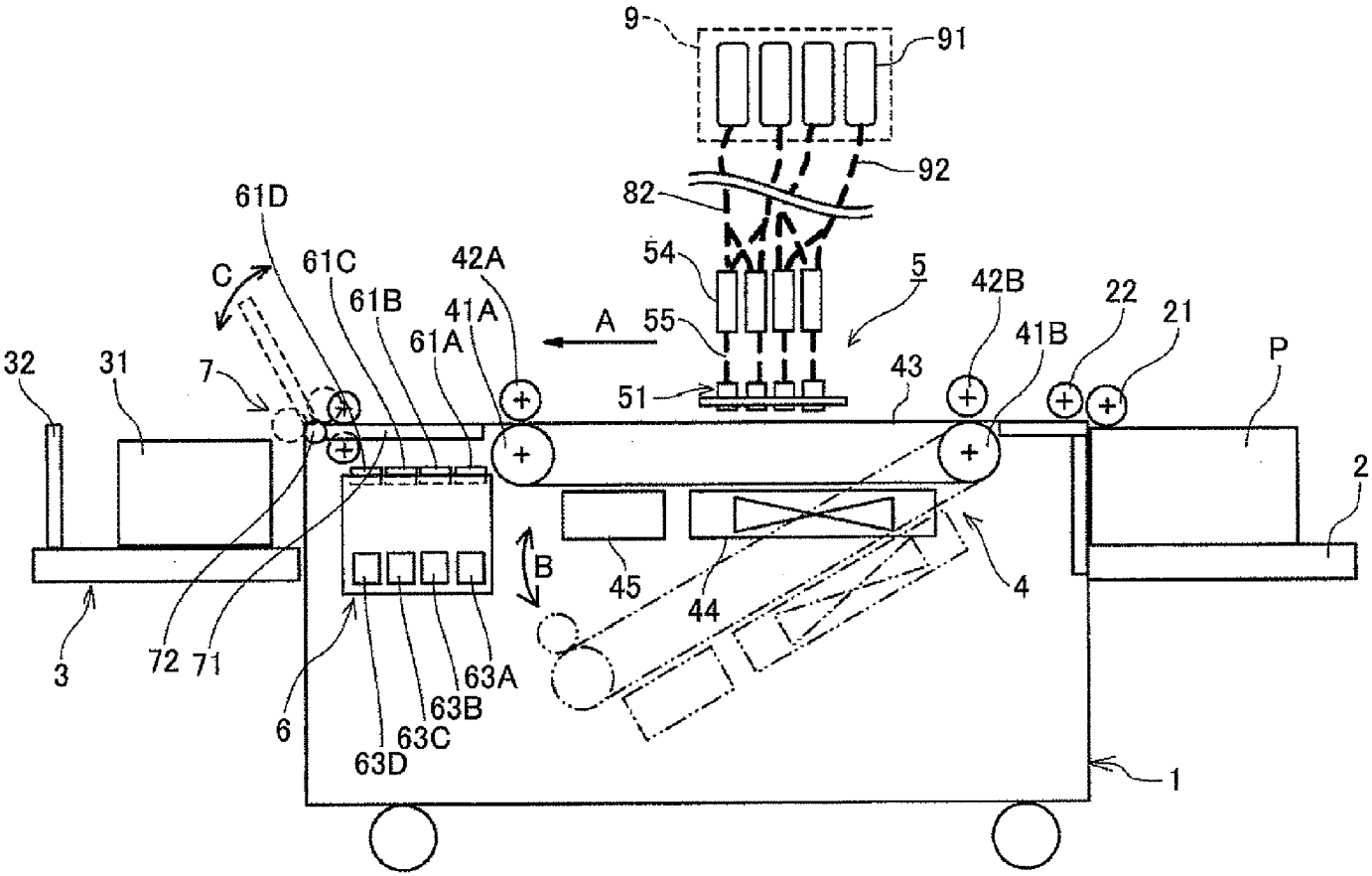
FIG. 1 is a schematic front diagram illustrating an overall configuration of an example of an image forming apparatus according to an embodiment.
Figure 2:
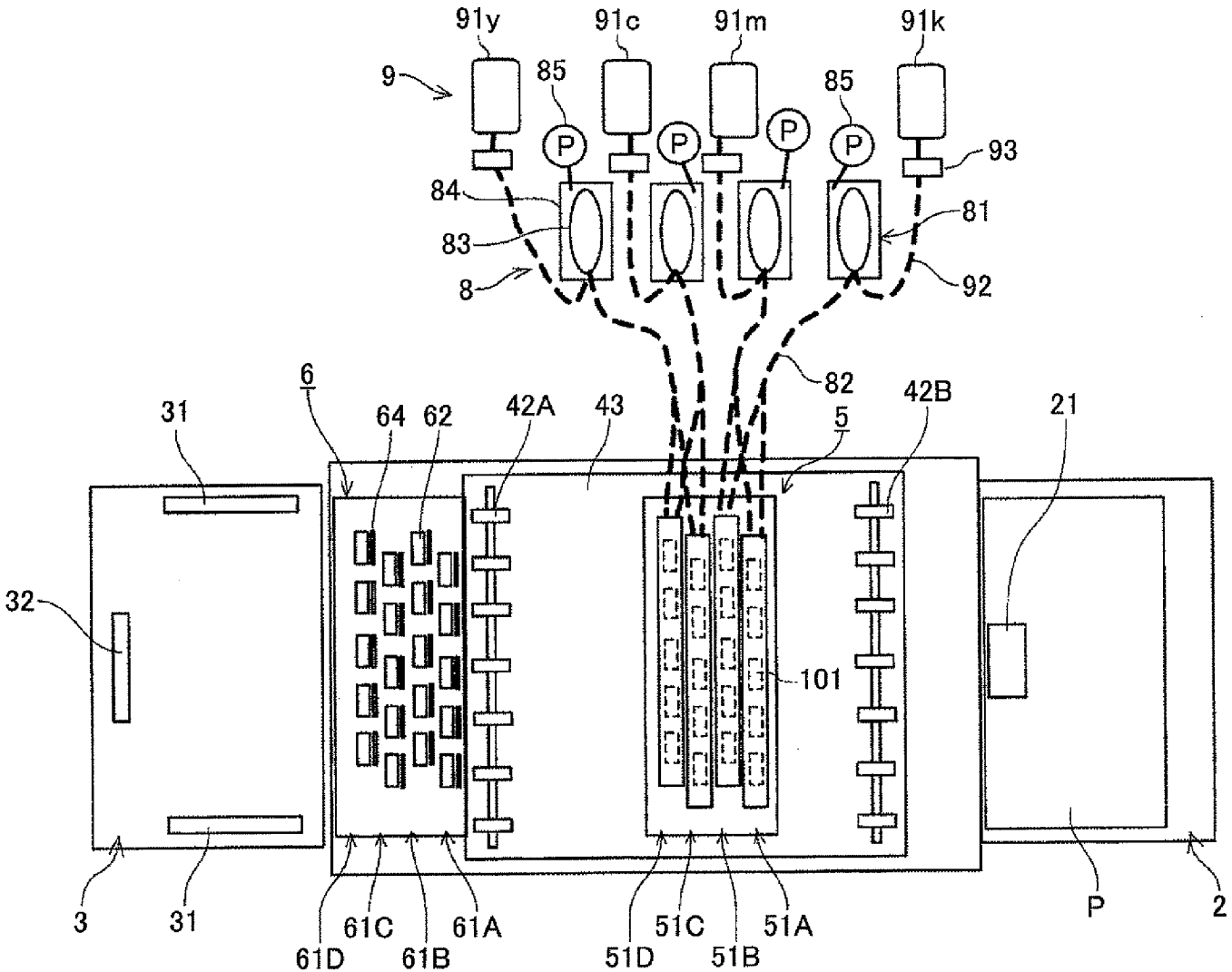
FIG. 2 is a plan diagram illustrating main components of the image forming apparatus according to an embodiment.

In the following, preferred embodiments will be described with reference to the accompanying drawings. First, an example of an image forming apparatus according to an embodiment is described with reference to FIGS. 1 and 2. Note that FIG. 1 is a schematic configuration diagram illustrating an overall configuration of the image forming apparatus according to an embodiment and FIG. 2 is a schematic plan diagram illustrating the image forming apparatus of FIG. 1.

The image forming apparatus according to an embodiment is a line-type image forming apparatus that includes a main body 1, a paper feed tray 2 configured to accumulate sheets P and feed the sheet one at each feed, an output tray 3 configured to accumulate the printed sheets P, a transfer unit 4 configured to transfer the sheet P from the paper feed tray 2 to the output tray 3, an image forming unit 5 having head modules 51 forming recording heads configured to carry out printing by discharging liquid droplets onto the sheet P transferred by the transfer unit 4, a head cleaner device 6 serving as a maintenance and recovery mechanism configured to maintain the recording heads of the image forming unit at a predetermined timing after printing, a transfer guide unit 7 configured to open or close the head cleaner device, an ink tank unit 8 formed of sub-tanks configured to supply ink to the respective head modules 51 of the image forming unit 5, and a main-tank unit 9 configured to supply ink to the ink tank unit 8.

The main body 1 is formed of front, rear and side plates and stays, and the sheets P accumulated on the paper feed tray 2 are fed to the transfer unit 4 one sheet at each time separated by a separation roller 21 and a paper feed roller 22.

The transfer unit 4 includes a transfer driving roller 41A, a transfer driven roller 41B and an endless transfer belt 43 that is looped over the transfer driving roller 41A and the transfer driven roller 41B. The endless transfer belt 43 includes suction pores (not illustrated) in its surface, and a suction fan 44 configured to suction the sheet P is arranged beneath the endless transfer belt 43. Further, transfer guide rollers 42A and 42B supported by (not-illustrated) guides are respectively arranged above the transfer driving roller 41A and the transfer driven roller 41B such that the transfer guide rollers 42A and 42B are brought into contact with the endless transfer belt 43 by their self weights.

The endless transfer belt 43 is configured to circumferentially travel by the rotational movement of the transfer driving roller 41A, which is driven by a (not-illustrated) motor. The sheet P is suctioned onto the endless transfer belt 43 by the suction fan 44 such that the sheet P is transferred by the rotational traveling of the endless transfer belt 43. Note that the transfer driven roller 41B, the transfer guide rollers 42A and 42B are rotationally driven by the rotational traveling of the endless transfer belt 43. Note also that a non-printing liquid discharge cleaner device 45 is arranged beneath the endless transfer belt 43 to remove non-printing liquid discharge attached to the endless transfer belt 43.

The image forming unit 5 formed of the head modules 51 is movably arranged above the transfer unit 4 in a direction indicated by an arrow A, and the head modules 51 are configured to discharge printing liquid to carry out printing on the sheet P. The image forming unit 5 is configured to be located to a position above the head cleaner device 6 when the image forming unit 5 is cleaned by the head cleaner device 6 that carries out a maintenance and recovery operation (i.e., cleaning operation) and be located back to a position illustrated in FIG. 1 when the image forming unit 5 carries out an image forming operation.

The image forming unit 5 includes the head modules (recording head unit) 51A, 51B, 51C and 51D each having an array of liquid discharge head units (hereinafter simply caller "head units") 101 each integrally formed of heads and corresponding head tanks. The head modules 51A, 51B, 51C and 51D of the image forming unit 5 are arranged in a line-base member (not illustrated) along a sheet transfer direction.

In the image forming unit 5, one of the two nozzle arrays in each of the head modules 51A and 51B discharges yellow (Y) liquid droplets and the other one of the nozzle arrays discharges magenta (M) liquid droplets, while one of the two nozzle arrays in each of the head modules 51C and 51D discharges cyan (C) liquid droplets and the other one of the nozzle arrays discharges black (K) liquid droplets. That is, in the image forming unit 5, two of the head modules 51 configured to discharge droplets of the same color are arranged in the sheet transfer direction. The two head modules 51 form one nozzle array, a length of which corresponds to the sheet width of the sheet P.

Respective distribution tanks 54 configured to supply ink to the head units 101 are provided above the head modules 51, where the distribution tanks 54 and the head units 101 are connected via respective tubes 55. Respective sub-tanks 81 are arranged upstream of the distribution tanks 54, where the distribution tanks 54 and the sub-tanks 81 are connected via respective supply tunes 82. Respective main-tanks 91 configured to store ink are arranged upstream of the sub-tanks 81, where the main-tanks 91 and the sub-tanks 81 are connected via respective supply paths formed of the supply tubes 92.

The transfer guide unit 7 is arranged downstream of the transfer unit 4 and configured to guide the transferred sheet P being discharged from the transfer unit 4 to the output tray 3. That is, the transferred sheet P is discharged onto the output tray 3 while being guided by the transfer guide unit 7. The output tray 3 includes a pair of side fences 31 configured to regulate the sheet P alignment in the width direction and an end fence 32 to regulate a front-end alignment of the sheet P.

The maintenance and recovery mechanism (i.e., head cleaner device) 6 includes four array cleaner units 61A to 61D configured to face the respective head modules 51 of the image forming unit 5. Each of the cleaner units 61 includes cap members 62 to cap nozzle surfaces of the respective heads 101 and wiping members (wiper members) 64 to wipe the nozzle surfaces of the respective heads 101. Note that each array of the cap members 61 may be individually moved in an upward direction and a downward direction. Further, respective suction pumps 63A to 63D serving as suction unit are arranged beneath the cleaner unit 61 and configured to suction ink from the nozzles of the head units 101 while the nozzle surfaces of the head units 101 are being capped with the cap members 62.

In the image forming apparatus according to an embodiment, when ink is suctioned from the nozzles of the head units 101 of the head modules 51 with the nozzle surfaces being capped by the cleaning units 61, the entire transfer unit 4 turns, after stopping printing, on the transfer driven roller 41B as a fulcrum point in a downward direction indicated by a bidirectional arrow B as illustrated in FIG. 1. Or, when the respective wiping members 64 wipes ink attached to the nozzle surfaces of the head units 101 of the head modules 51 after printing, the entire transfer unit 4 turns, after stopping printing, on the transfer driven roller 41B as a fulcrum point in a downward direction indicated by a bidirectional arrow B as illustrated in FIG. 1. Accordingly, sufficient space may be provided between the image forming unit 5 and the transfer unit 4 for allowing the movement of the image forming unit 5. The space formed between the transfer unit 4 and the image forming unit 5 when the cleaning is carried out (the cleaning time) may be larger than the space formed between them when an image forming operation is carried out (the image forming time). At this moment, a transfer guide plate 71 of the transfer guide unit 7 may also turn on a fulcrum 72 in an upward direction indicated by a bidirectional arrow C in FIG. 1 such that an upper part of the head cleaner device 6 is opened.

When the transfer unit 4 and the transfer guide unit 7 are released, the image forming unit 5 is moved in a sheet passing direction (indicated by an arrow A) and then stopped at a position above the head cleaner device 6. In this state, the cleaner units 61 are raised for carrying out cleaning operations (maintenance and recovery operations) on the respective head modules 51.

Figure 3:
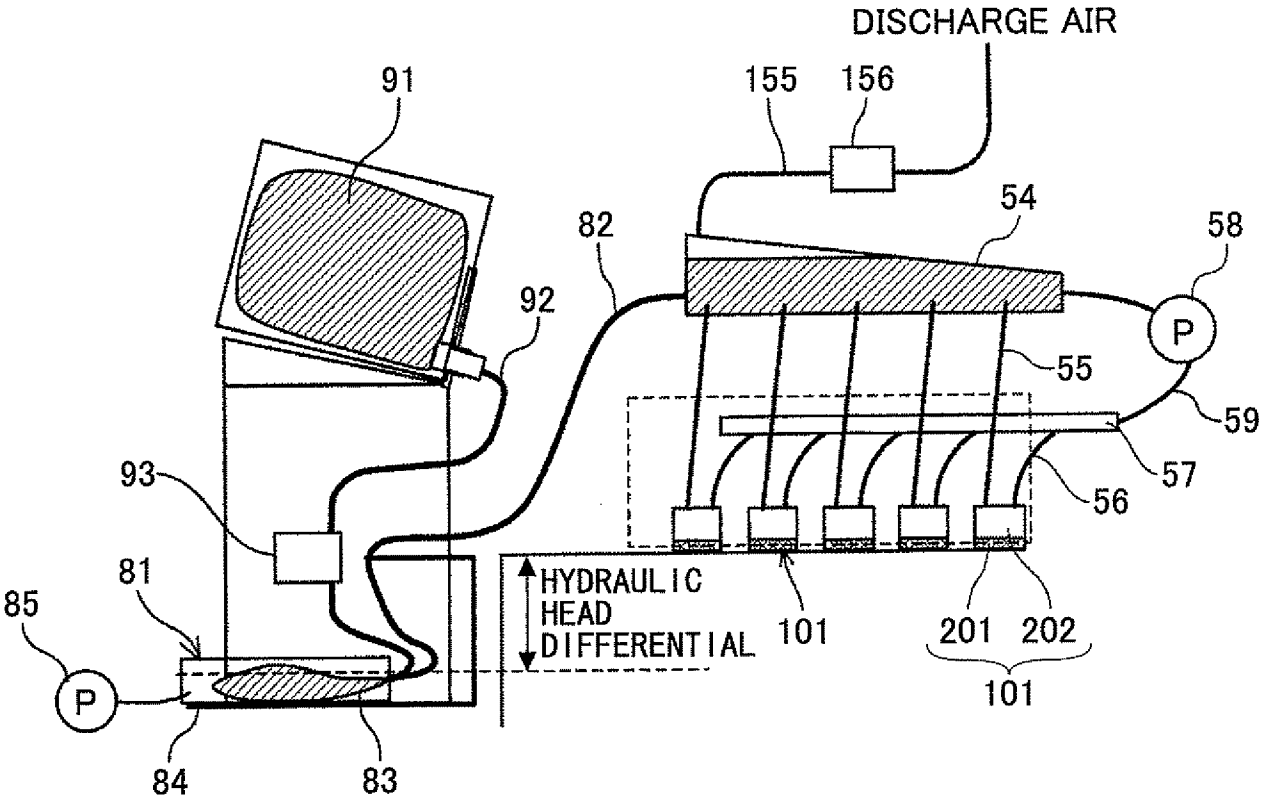
FIG. 3 is a diagram illustrating an ink supply system provided in the image forming apparatus according to an embodiment.
Figure 4:
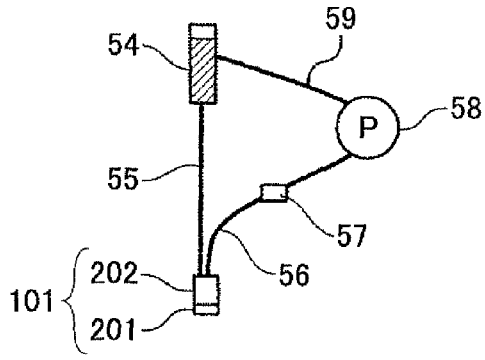
FIG. 4 is a side diagram illustrating main components of the ink supply system of FIG. 3.

Next, an ink supply system including the head modules 51 of the image forming apparatus is described in more detail with reference to FIGS. 3 and 4. The sub-tank 81 and the distribution tank 54 of the head module 51 are connected via the supply tube 82 such that appropriate negative pressures for maintaining meniscus of the nozzles are generated due to a hydraulic head differential (in a range of −20 to −70 mmAq) between the sub-tank 81 and the nozzle surfaces of the head unit 101. As will be described later, the head unit 101 includes a head 201 configured to discharge a liquid and a head tank 202 configured to supply ink to the head 201.

The sub-tank 81 is a packing type sub-tank. That is, the sub-tank 81 includes a flexible pack 83 and a closed case 84. Since the packing type sub-tank will not allow ink to be directly exposed to air (atmosphere), an increase in the viscosity of the ink due to evaporation of water in the ink may be prevented. Further, since the packing type sub-tank may maintain a constant amount of dissolved oxygen in the ink, air bubble accumulation in the ink inside the head unit 101 may be prevented.

The sub-tank 81 is connected to a pressure pump 82 (tube pump) configured to pressurize a space between the flexible pack 83 and the closed case 84. When the maintenance operation before printing is carried out after a predetermined time has elapsed, the pressure pump 85 pressurizes the internal case 84 of the sub-tank 84 to supply ink to the head tank 201 of the head unit 101, which then causes the nozzles of the head 201 to discharge the ink. Note that the maintenance operation is performed after the image forming unit 5 has been moved to a position above the cleaner device 6.

The main-tank 91 configured to store ink are arranged upstream of the sub-tank 81, where the main-tank 91 and the sub-tank 81 are connected via the supply path formed of the supply tube 92. Further, a solenoid valve 93 is provided within the supply path of the supply tube 92, such that ink is supplied from the main-tank 91 to the sub-tank 81 by opening or closing the solenoid valve 93.

Moreover, an air discharge path 155 and a solenoid valve 156 configured to open or close the air discharge path 155 are provided above the distribution tank 54. Air is discharged from the distribution tank 54 by opening the solenoid valve 156 when ink is initially filled in the distribution tank 54 or when air is accumulated inside the distribution tank 54. Note that a slope is formed in a top surface of a common channel inside the distribution tank 54 in order to facilitate the discharge of air from the distribution tank 54.

Further, supply tubes 55 for supplying ink are connected between the head tanks 201 of the respective head units 101 and the respective distribution tanks 54. Moreover, discharge tubes 56 for discharging ink are connected to the head tanks 201 of the respective head units 101 such that the respective discharge tubes 56 are connected to the common path 57. Thus, the common path 57 to which the respective discharge tubes 56 are connected is connected to the distribution tank 54 via a circulating path 59 and a circulating pump 58.

Figure 5:
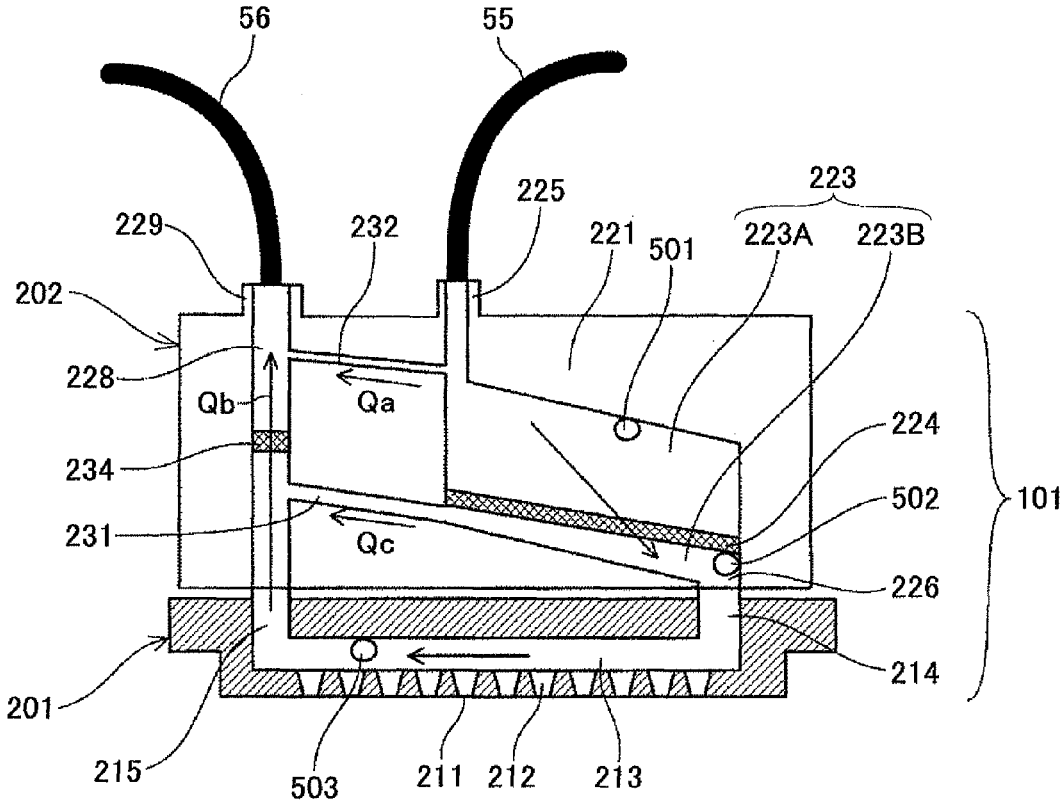
FIG. 5 is a schematic sectional diagram illustrating a head unit according to a first embodiment.

Next, details of the head unit 101 according to a first embodiment is described with reference to FIG. 5. FIG. 5 is a schematic sectional diagram illustrating the head unit 101. The head unit 101 includes a head 201 configured to discharge a liquid and a head tank 202 configured to store ink that is supplied to the head 202. The head 201 and the head tank 202 serving as a liquid container tank are integrally formed in the head unit 101. Note that "integrally formed" indicates that the head 201 and the head tank 202 are connected via tubes or pipes; however, it also indicates that the head 201 and the head tank 202 securely fixed by screws and O-rings in the connections of channels between the head 201 and the head tank 202.

The head 201 includes nozzles 211 configured to discharge liquid droplets, liquid chambers 212 communicating with the respective nozzles 211, a common liquid chamber (a common channel) 213 configured to supply ink to the respective liquid chambers 212, a common liquid chamber ink supply port (supply opening) 214 configured to supply (introduce) ink to the common liquid chamber (common channel) 213, and a common liquid chamber ink discharge port (discharge opening) 215 configured to discharge ink from the common liquid chamber (common channel) 213.

The head tank 202 includes a tank case (tank main body) 221 and an ink container 223 configured to contain ink inside the tank case 221. The ink container 223 includes a filter upstream chamber 223A and a filter downstream chamber 223B that are separated by a filtering member 224 configured to filter impurities in the ink.

The filter upstream chamber 223A is communicating with an ink supply port 225 connected to an ink supply tube 55, whereas the filter downstream chamber 223B is communicating with an ink supply channel 226 communicating with the common liquid chamber ink supply port 214 of the head 201.

Further, the tank case 221 includes a discharge path 228 configured to discharge ink discharged from the common liquid chamber discharge port 215 communicating with the common liquid chamber discharge port 215 of the head 201, and the discharge path 228 is communicating with an ink discharge port 229 to which an ink discharge tube 56 is connected.

The tank case 221 further includes a first communication path 231 serving as an air bubble eliminating path via which the filter downstream chamber 223B is communicating with the discharge path 228. The tank case 223 further includes a second communication path 232 serving as an air bubble eliminating path via which the filter upstream chamber 223A is communicating with the discharge path 228. The filtering member 234 is arranged between a first communicating section of the discharge path 228 communicating with the first communication path 231 and a second communicating section of the discharge path 228 communicating with the second communication path.

The first communication path 231 and the second communication path 232 are formed such that the fluid resistance of the first communication path 231 and that of the second communication path 232 are each higher than the fluid resistance of the common liquid chamber 213 of the head 201, and the fluid resistance of the first communication path 231 and that of the second communication path 232 are each higher than the fluid resistance of the ink supply channel 226. Further, the second communication path 232 is formed such that the fluid resistance of the second communication path is higher than the fluid resistance of the first communication path 231.

For example, the first communication path 231 communicating with the filter downstream chamber 223B has a size of $\phi$1.5*a length 20 mm and the second communication path 232 communicating with the filter upstream chamber 223A has a size of $\phi$1.5*a length 20 mm, compared to the ink supply path 226 having a size of $\phi$2.5*a length 2 mm. In general, the fluid resistance R is expressed by $R=128\ \mu L/(\pi d^4)*1.045$ [$Pa\cdot s/m^3$] ($\mu$: viscosity, L: length of round tube, d: radius). In this case, the fluid resistance of the second communication path 232 is approximately five times the fluid resistance of the first communication path 231.

Figure 6:
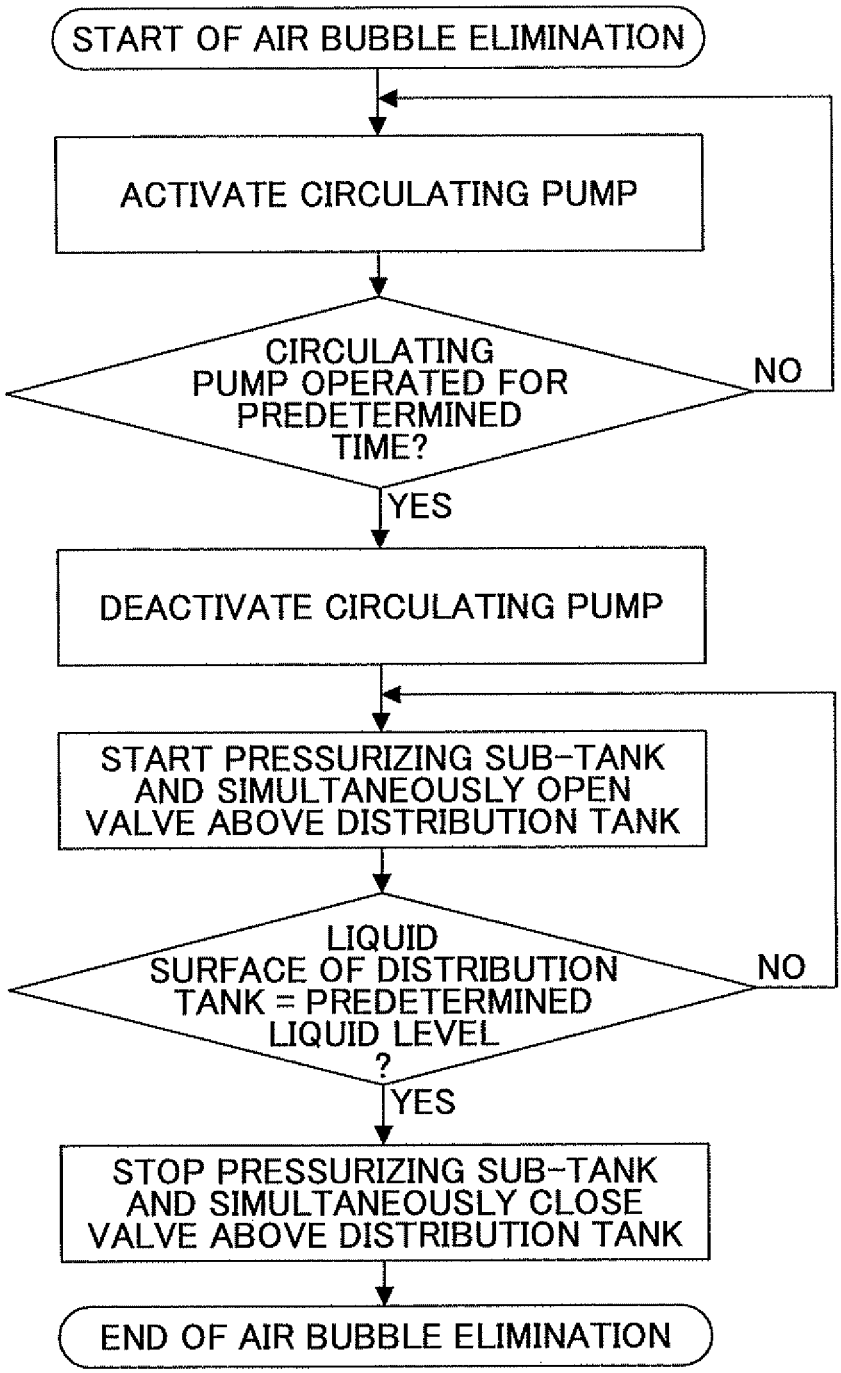
FIG. 6 is a flowchart illustrating an air bubble eliminating operation.

Next, an air bubble eliminating operation carried out on the head unit 101 having the above configuration is described with reference to a flowchart illustrated in FIG. 6. First, a circulation pump 58 is activated such that a flow is circulated in the order of the distribution tank 54, the head tank 202, a common path 57 and the distribution tank 54 (see also FIG. 4). While the flow is circulated in an above-described fashion, air bubbles are gradually accumulated in an upper part of the distribution tank 54 such that the accumulated air bubbles form a large air ball. Then, after the circulation pump 58 is operated for a predetermined time (e.g., 10 to 30 sec.), the circulation pump 58 is deactivated. Thereafter, the sub-tank 81 is pressurized such that ink is supplied from the sub-tank 81 to the distribution tank 54 while air is discharged by opening (releasing) a valve 56 above the distribution tank 54, simultaneously. Further, a liquid surface detecting sensor (not-illustrated) is provided at the upper part of the distribution tank 54. When the liquid surface detecting sensor detects that a surface of the liquid in the distribution tank 54 reaches a predetermined level (predetermined height), the pressurizing operation of the sub-tank 81 is simultaneously stopped and the valve 56 above the distribution tank 54 is closed. The air bubbles mixed within the ink supply path and the head tank 202 are thus eliminated by the air bubble eliminating operation described above.

Next, elimination of air bubbles in the ink inside the head unit 101 is described. For example, an air bubble 501 is mixed into the filter upstream chamber 223A of the head tank 202, an air bubble 502 is mixed into the filter downstream chamber 223B of the head tank 202, and an air bubble 503 is mixed into the common liquid chamber 213 of the head 201. In this case, the air bubble 503 mixed in the common liquid chamber 213 may be eliminated easily by carrying out the above-described circulation operation. The air bubble 502 mixed in the filter downstream chamber 223B located downstream of the filtering member 224 may be eliminated via the first communication path 231 and the discharge path 228. Further, the air bubble 501 mixed in the filter upstream chamber 223A located upstream of the filtering member 224 may be eliminated via the second communication path 232 and the discharge path 228.

In this case, since the fluid resistance of the second communication path 232 is higher than the fluid resistance of the first communication path 231, the amount of ink passing through the second communication path 232 is more restricted than the amount of ink passing through the first communication path 231.

As a result, the flow amount Qc flowing in the first communication path 231, the flow amount Qa flowing in the second communication path 232 and the flow amount Qb flowing downstream of the filtering member 234 inside the discharge path 228 become approximately the same.

That is, if the fluid resistance of the first communication path and the fluid resistance of the second communication path 232 are the same, the ink flowing inside the first communication path 231 receives both the fluid resistance of the first communication path 231 and the fluid resistance of the filtering member 234. As a result, the flow amount Qc flowing in the first communication path 231 may be increased (i.e., Qc>Qa, Qb), which may lengthen the time for eliminating the air bubbles.

Thus, the flow amount of the ink flowing in the second communication path 232 is restricted by increasing the fluid resistance of the second communication path 232 such that the fluid resistance of the second communication path 232 is higher than the fluid resistance of the first communication path 231, which may equate the flow amounts Qc, Qa and Qb. In this fashion, the air bubble 502 mixed in the filter downstream chamber 223B may be efficiently eliminated, and the time required for the air bubble elimination may be reduced.

Figure 7:
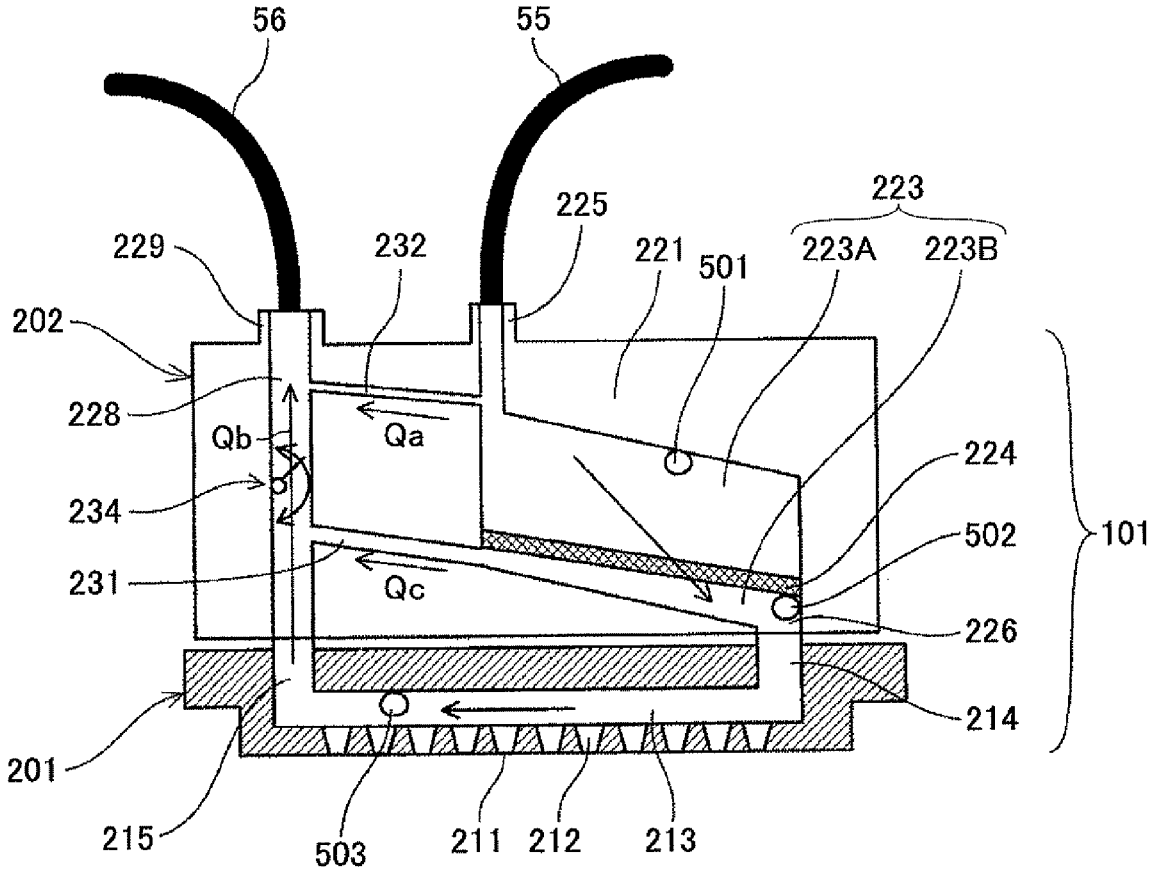
FIG. 7 is a schematic sectional diagram illustrating a head unit according to a second embodiment.

Next, details of a head unit 101 according to a second embodiment is described with reference to FIG. 7. FIG. 2 is a schematic sectional diagram illustrating the head unit 101. In the head unit 101 according to the second embodiment, a non-return valve (impurity prevention unit) 235 configured to allow the ink to flow in a discharge direction and prevent the ink from flowing in a backward direction is provided in place of the filtering member 234 provided in the discharge path 228 in the first embodiment.

With this configuration, the ink that flows from the filter upstream chamber 223 through the second communication path 232 to the discharge path 228 in a normal discharge operation but has not passed through the filtering member 224 is prevented from being mixed inside the head 201 side via the discharge path 228.

Figure 8:
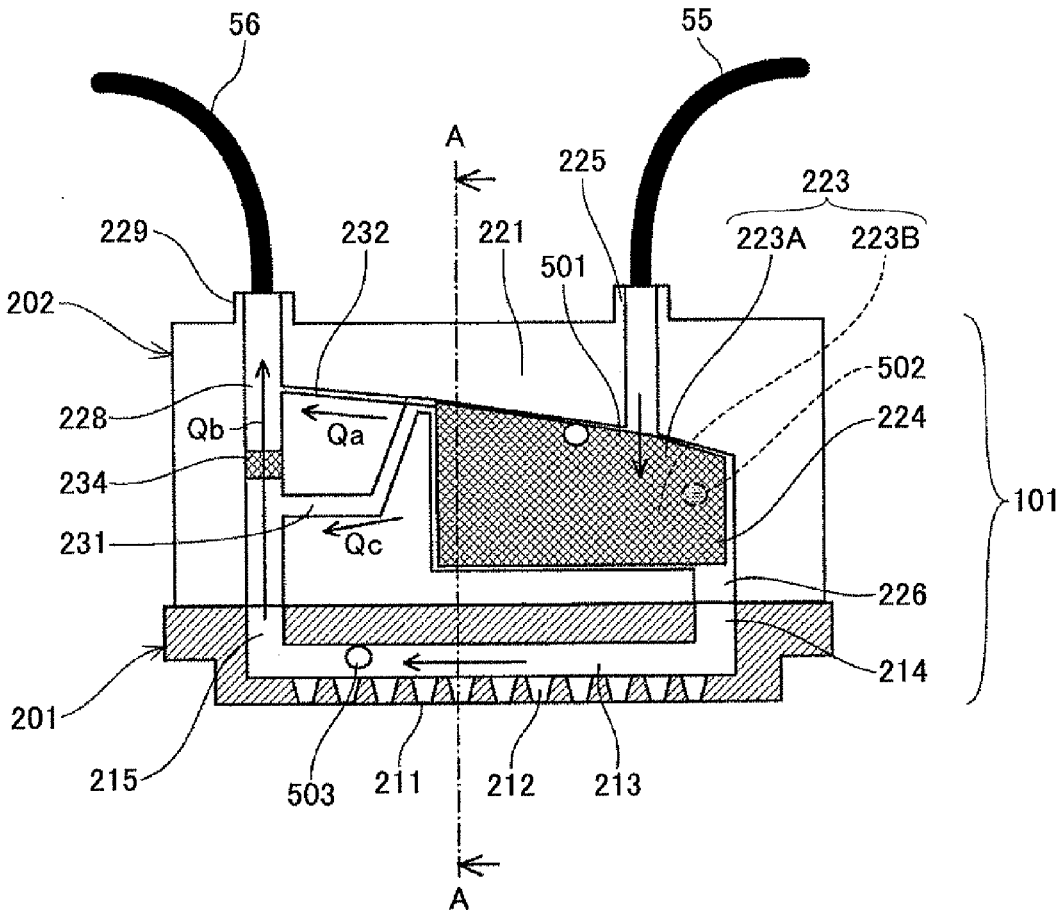
FIG. 8 is a schematic sectional diagram illustrating a head unit according to a third embodiment.
Figure 9:
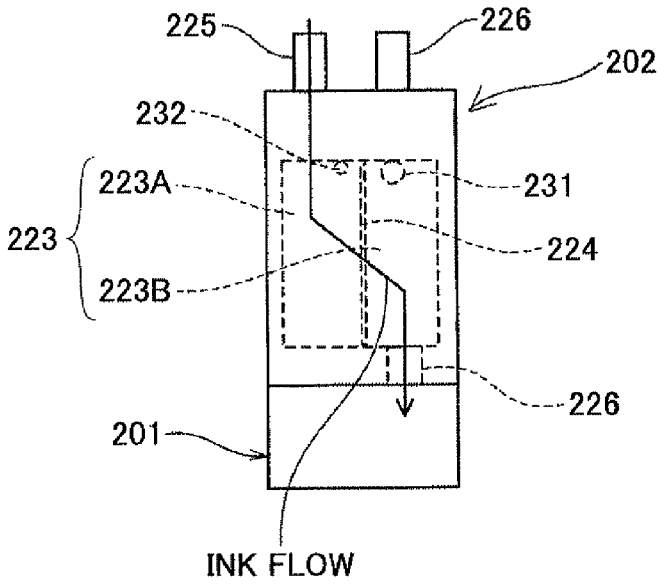
FIG. 9 is a side diagram illustrating main components of the head unit of FIG. 8.
Figure 10:
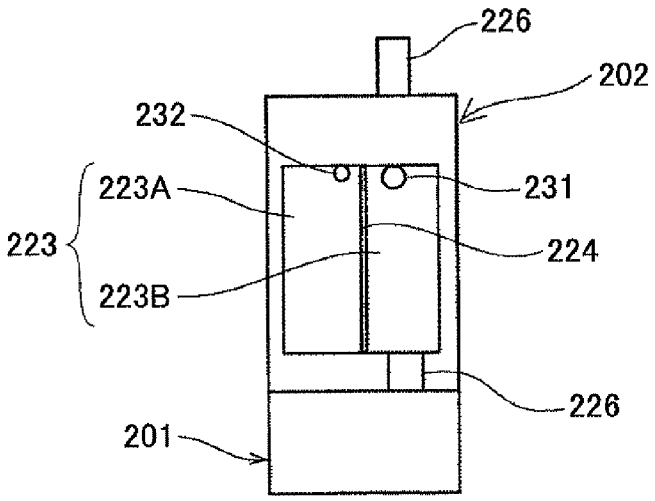
FIG. 10 is a cross sectional diagram of the head unit of FIG. 8 taken along an A-A line.

Next, details of a head unit 101 according to a third embodiment is described with reference to FIGS. 8 to 10. Note that FIG. 8 is a schematic sectional diagram of the head unit 101, FIG. 9 is a side diagram of the head unit 101 of FIG. 8 and FIG. 10 is a sectional front diagram cut across an A-A line of the head unit 101 of FIG. 8. In the head unit 101 according to the third embodiment, the filtering member 224 is arranged along an ink supply direction (i.e., a vertical direction), and the filter upstream chamber 223A and the filter downstream chamber 223B in the ink container 223 are arranged in a horizontal direction, where an entrance port of the first communication path 231 is provided in a top surface of the filter downstream chamber 223B and an entrance port of the second communication path 232 is provided in a top surface of the filter upstream chamber 223A. Other components of the head unit 101 are the same as those illustrated in the first embodiment.

With this configuration, an effective area (i.e., an area capable of removing impurities) of the filtering member 224 may be increased while reducing the width of the head tank 202. Accordingly, the head unit 101 (liquid discharge head unit) may be reduced in size without reducing the effective area of the filtering member 224.

Figure 11:
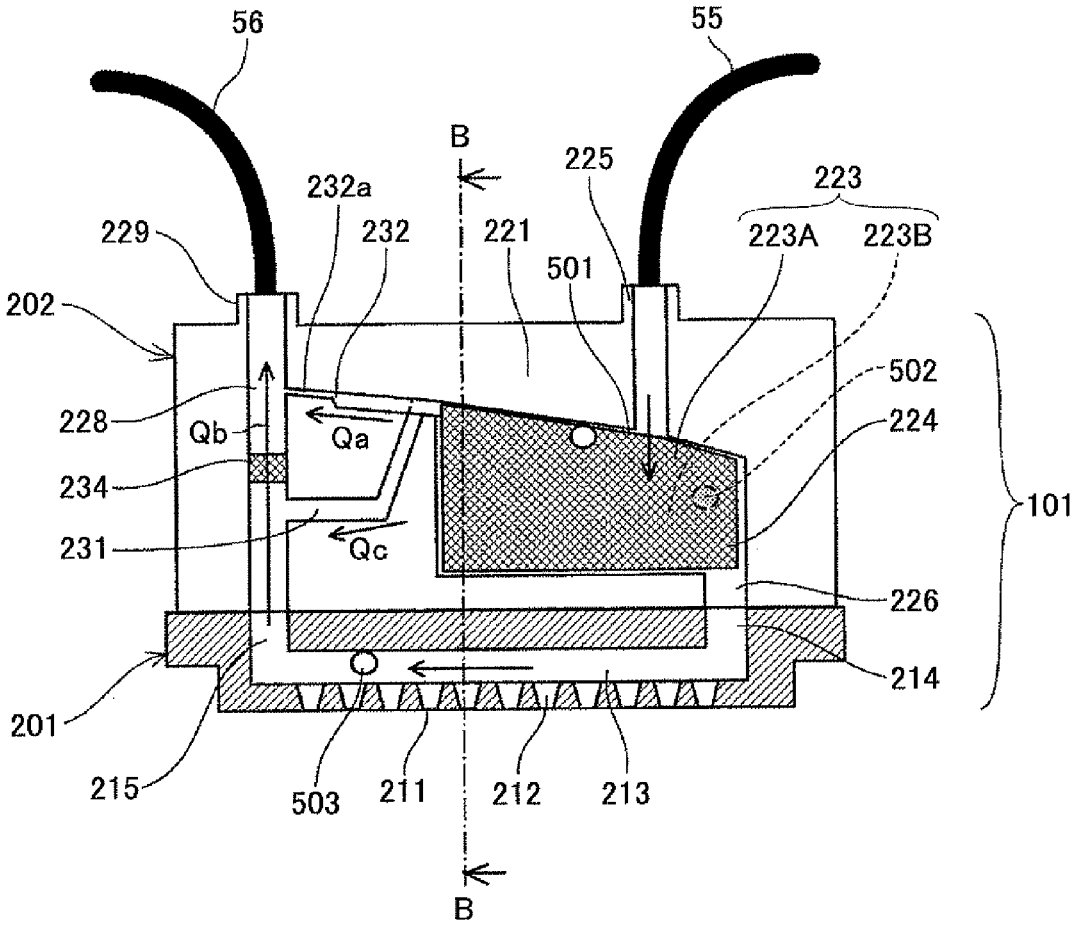
FIG. 11 is a schematic sectional diagram illustrating a head unit according to a fourth embodiment.
Figure 12:
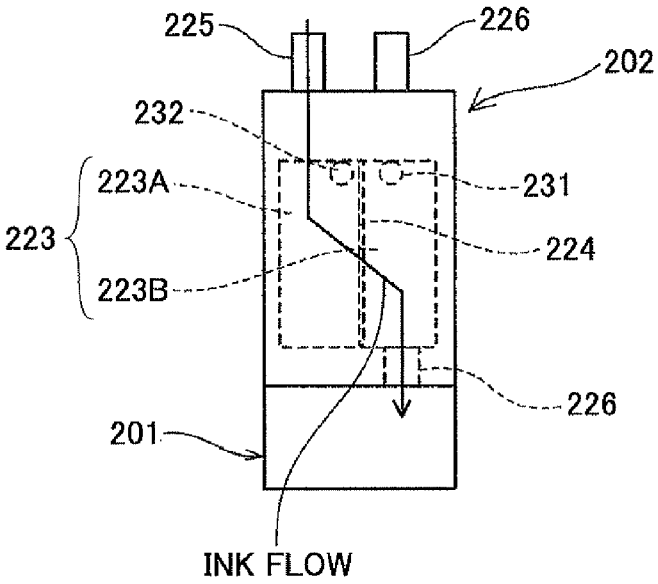
FIG. 12 is a side diagram illustrating main components of the head unit of FIG. 11.
Figure 13:
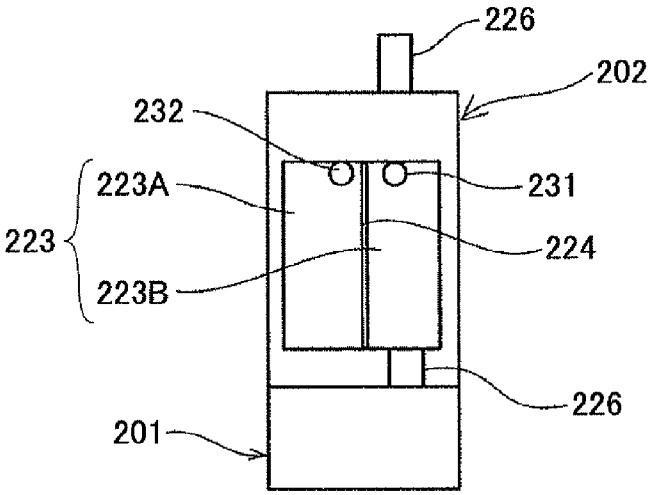
FIG. 13 is a cross sectional diagram of the head unit of FIG. 11 taken along a B-B line.

Next, details of a head unit 101 according to a fourth embodiment is described with reference to FIGS. 11 to 13. Note that FIG. 11 is a schematic sectional diagram of the head unit 101, FIG. 12 is a side diagram of the head unit 101 of FIG. 11 and FIG. 13 is a sectional front diagram cut across a B-B line of the head unit 101 of FIG. 11. As illustrated in FIG. 11, in the head unit 101 according to the third embodiment, the second communication path 232 has a portion 232*a* having a cross-sectional area smaller (narrower) than the cress-sectional area of the rest of the second communication path 232 in a direction perpendicular to a liquid flow direction, which may partially increase the fluid resistance of the second communication path 232. For example, the portion 232*a* of the second communication path 232 has a size of ϕ0.8*5 mm and the rest of the second communication path 232 has a size of ϕ1.5*15 mm.

Figure 14:
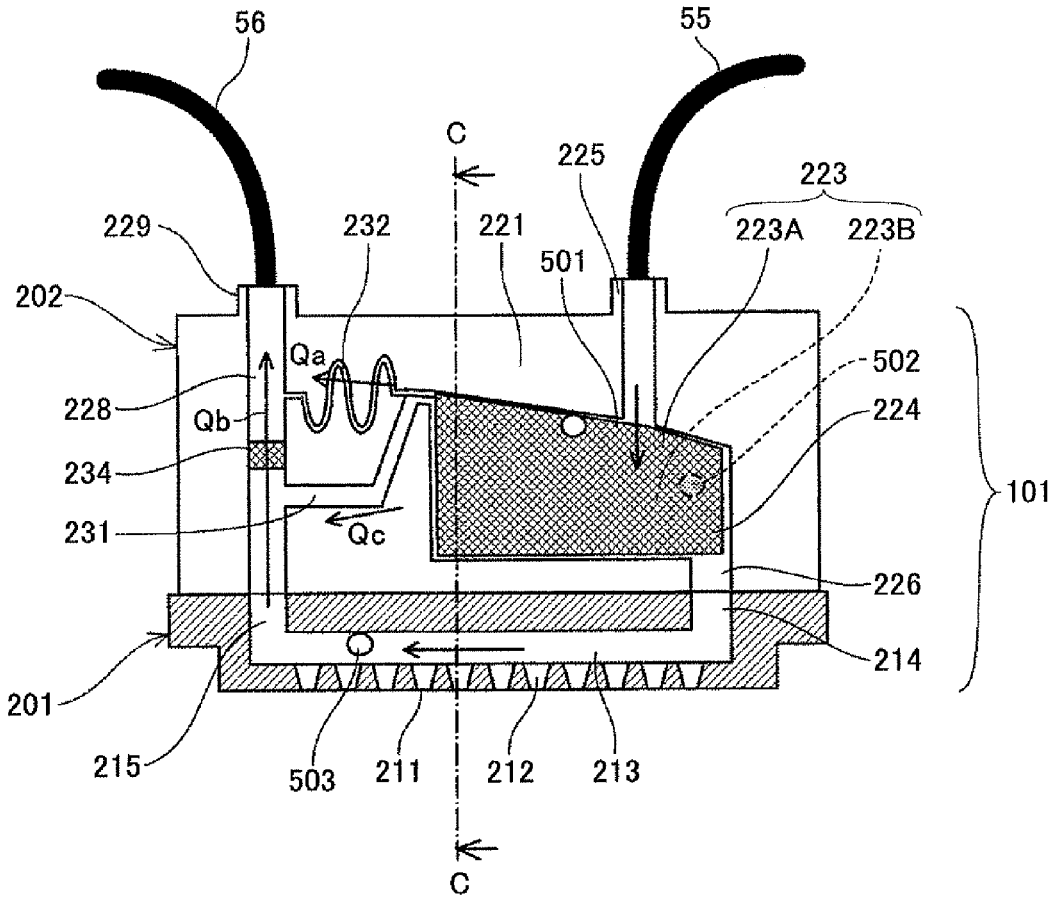
FIG. 14 is a schematic sectional diagram illustrating a head unit according to a fifth embodiment.
Figure 15:
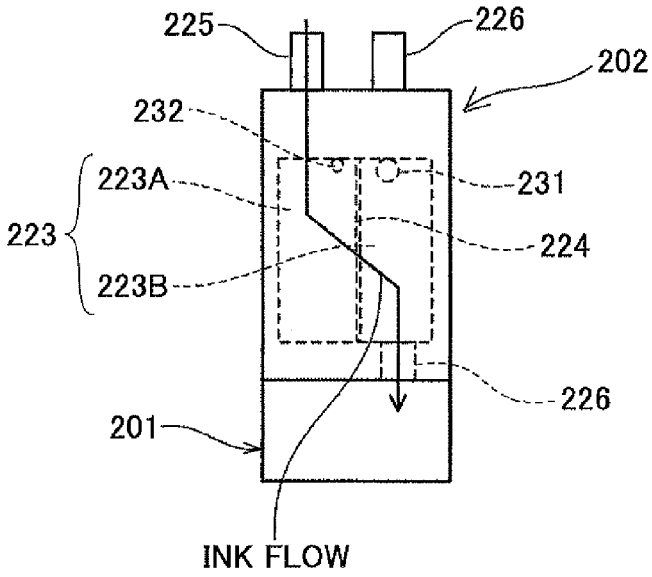
FIG. 15 is a side diagram illustrating main components of the head unit of FIG. 14.
Figure 16:
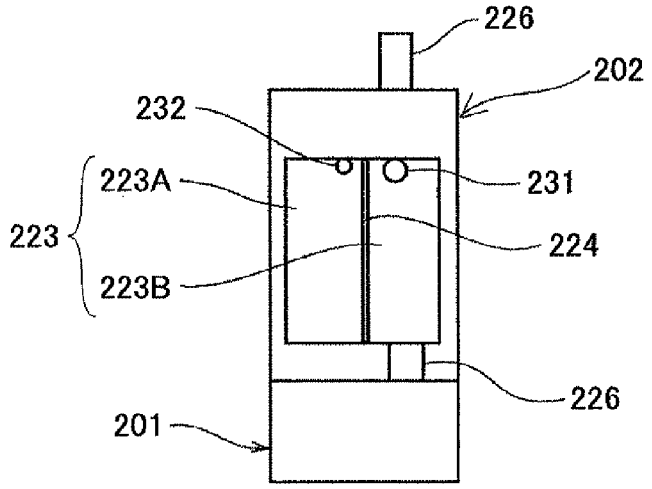
FIG. 16 is a cross sectional diagram of the head unit of FIG. 14 taken along a C-C line.

Next, details of a head unit 101 according to a fifth embodiment is described with reference to FIGS. 14 to 16. Note that FIG. 14 is a schematic sectional diagram of the head unit 101, FIG. 15 is a side diagram of the head unit 101 of FIG. 14 and FIG. 16 is a sectional front diagram cut across a C-C line of the head unit 101 of FIG. 14. As illustrated in FIG. 14, in the head unit 101 according to the third embodiment, the second communication path 232 has two or more bending portions along a liquid flow direction, which may increase the fluid resistance of the second communication path 232 due to the increased channel length of the second communication path 232. For example, the second communication has a size of ϕ1.5*30 mm.

Figure 17:
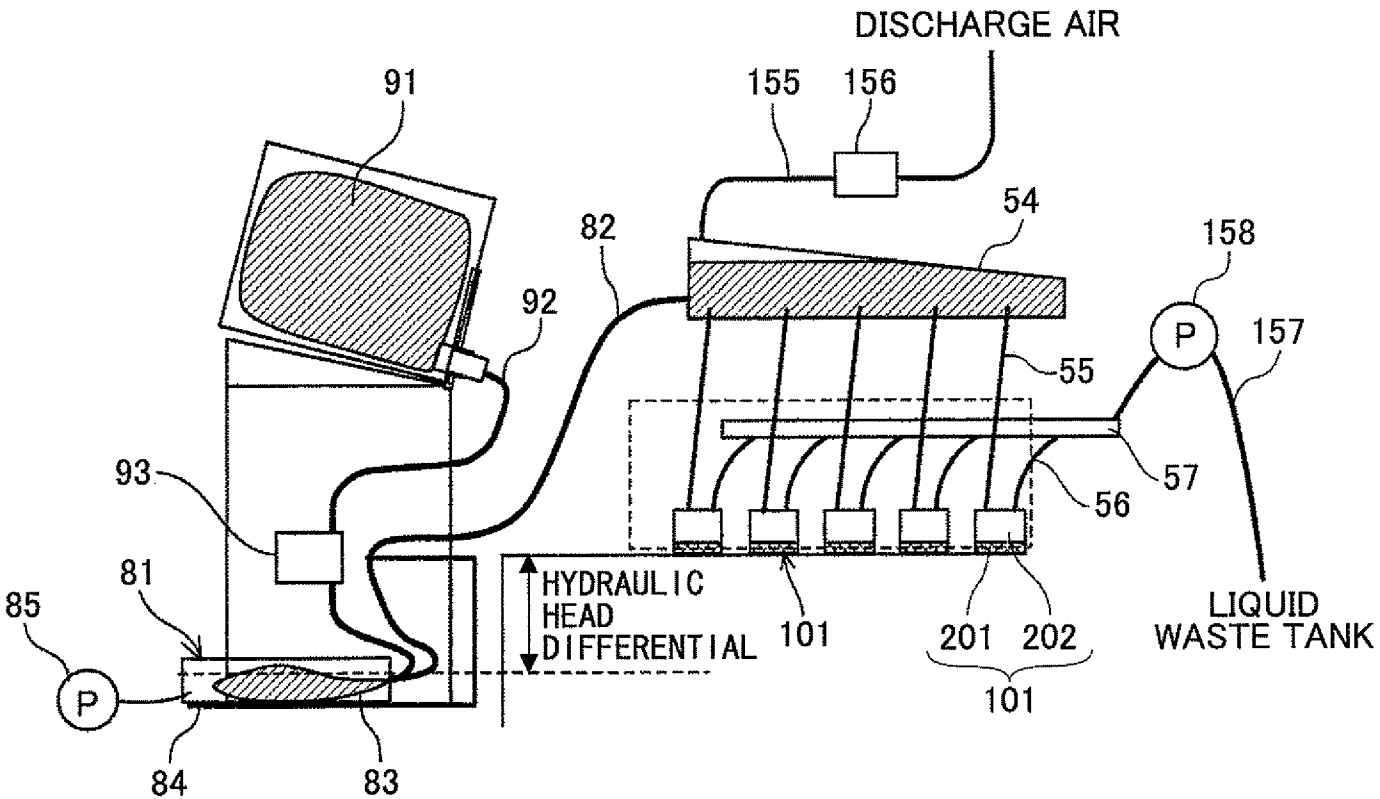
FIG. 17 is a diagram illustrating an ink supply system provided in a head unit according to a sixth embodiment.
Figure 18:
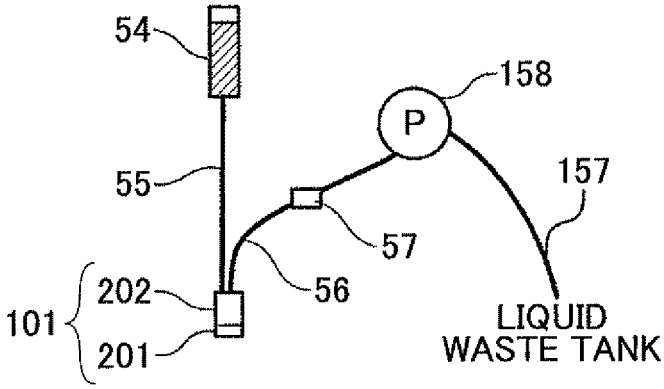
FIG. 18 is a side diagram illustrating main components of the ink supply system of FIG. 17.

Next, a head unit 101 according to a sixth embodiment is described with reference to with reference to FIGS. 17 and 18. Note that FIG. 17 is a diagram illustrating an ink supply system of the head unit 101 according to the sixth embodiment, and FIG. 18 is a diagram illustrating main components of the ink supply system of FIG. 17. In the head unit 101 according to the sixth embodiment, an air-bubble elimination path 157 is provided with the common path 57 such that the common path 57 is communicating with a liquid waste tank (not-illustrated) via the air-bubble elimination path 157. Further, the air-bubble elimination path 157 is provided with an air-bubble elimination pump 158.

Figure 19:
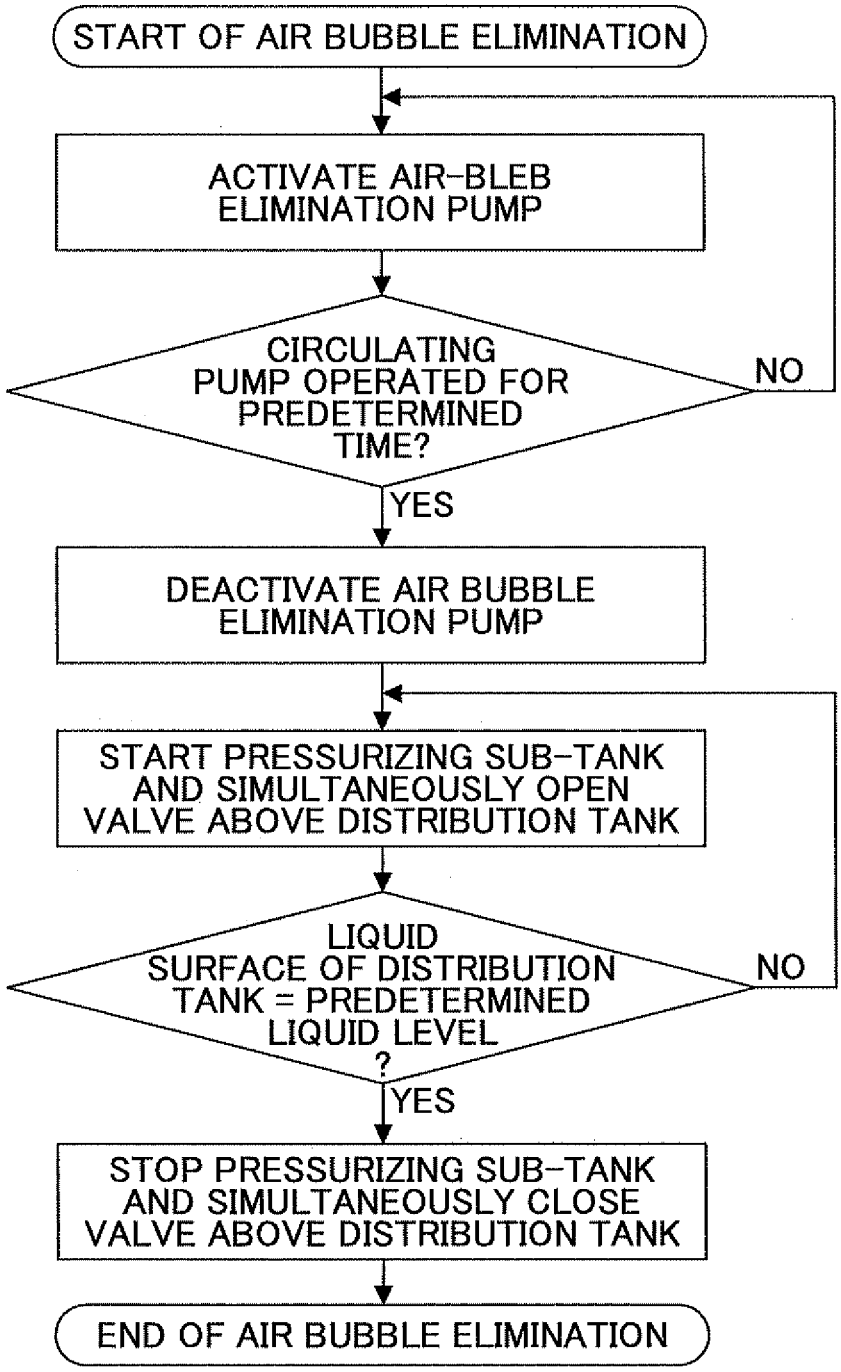
FIG. 19 is a flowchart illustrating an air bubble eliminating operation carried out in the ink supply system of FIG. 17.

An air bubble eliminating operation for eliminating air bubbles from an ink supply path and the head tank 202 of this ink supply system is described with reference to FIG. 19.

First, the air-bubble elimination pump 158 is activated such that a flow is circulated in the order of the distribution tank 54, the head tank 202, the air-bubble elimination path 157 and the liquid waste tank. Such an air bubble eliminating operation is conducted for a predetermined time (e.g., in a range of 10 to 30 sec).

Next, the air-bubble elimination pump 158 is deactivated, and the sub-tank 81 is pressurized such that ink is supplied from the sub-tank 81 to the distribution tank 54 while air is discharged by opening (releasing) a valve 156 above the distribution tank 54, simultaneously (i.e., the air bubbles mixed when replacing an ink pack is discharged from the valve above the distribution tank 54).

A liquid surface detecting sensor (not-illustrated) is provided at the upper part of the distribution tank 54. When the liquid surface detecting sensor is activated, the pressurizing operation of the sub-tank 81 is stopped and the valve 156 above the distribution tank 54 is closed.

The air bubbles mixed within the ink supply path and the head tank 202 are thus eliminated by the air bubble eliminating operation described above.

As described above, since the head unit 101 is configured to eliminate air bubbles to the liquid waste tank during the air bubble eliminating operation, the air bubbles may be efficiently eliminated, which may result in liquid waste reduction.

Note that examples given above are based on the line type image forming apparatus to which the head unit 101 according to the above-described embodiments are applied; however, the head unit 101 according to the above-described embodiments may also be applied to the serial type image forming apparatus.

The liquid discharge head unit according to the embodiments includes the first communication path via which the downstream chamber communicates with the discharge path of the head tank 202; the second communication path via which the upstream chamber communicates with the discharge path of the head tank 202, where the fluid resistance of the second communication path is higher than the fluid resistance of the first communication path. With this configuration, air bubbles mixed into the liquid inside the head tank may be eliminated and air bubbles entered from the head tank may be suppressed.

Further, since the image forming apparatus according to the embodiments includes the liquid discharge head unit according to the embodiments, the image forming apparatus may be capable of stably discharging ink for forming images.

According to an embodiment, there is provided a liquid discharge head unit that includes a liquid container tank configured to store a liquid; and a head configured to receive the liquid from the liquid container tank to discharge liquid droplets, the head and the liquid container tank being integrally formed. In the liquid discharge head unit, the head includes a common channel configured to supply the liquid to a plurality of liquid chambers communicating with nozzles configured to discharge the liquid droplets, and the common channel includes a supply port configured to introduce the liquid from outside, and a discharge port configured to discharge the introduced liquid outside. Further, in the liquid discharge head unit, the liquid container tank includes a container configured to contain the liquid to be supplied to the head and including an upstream chamber and a downstream chamber separated via a filtering member, a supply path configured to supply the liquid from the downstream chamber of the container to the supply port of the head, a discharge path configured to discharge the liquid discharged from the discharge port of the head, a first communication path via which the downstream chamber communicates with the discharge path, and a second communication path via which the upstream chamber communicates with the discharge path, where a fluid resistance of the second communication path is higher than a fluid resistance of the first communication path.

According to an embodiment, there is provided the liquid discharge head unit in which one of a non-return valve and the filtering member is provided between a first communicating section of the discharge path communicating with the first communication path and a second communicating section of the discharge path communicating with the second communication path.

According to an embodiment, there is provided the liquid discharge head unit in which the second communication path partially includes a small cross sectional configuration perpendicular to a fluid flow direction of the liquid.

According to an embodiment, there is provided the liquid discharge head unit in which the second communication path has a longer channel than that of the first communication path.

According to an embodiment, there is provided the liquid discharge head unit in which the filtering member is arranged along a direction toward which the head discharges the liquid droplets.

According to an embodiment, there is provided an image forming apparatus that includes the above liquid discharge head unit.

Embodiments of the present invention have been described heretofore for the purpose of illustration. The present invention is not limited to these embodiments, but various variations and modifications may be made without departing from the scope of the present invention. The present invention should not be interpreted as being limited to an embodiments that are described in the specification and illustrated in the drawings.

The present application is based on Japanese Priority Application No. 2010-203360 filed on Sep. 10, 2010, with the Japanese Patent Office, the entire contents of which are hereby incorporated by reference.

What is claimed is:

1. A liquid discharge head unit comprising:

a liquid container tank configured to store a liquid; and a head configured to receive the liquid from the liquid container tank to discharge liquid droplets therefrom, the head and the liquid container tank being integrally formed, wherein the head includes a common channel configured to supply the liquid to a plurality of liquid chambers communicating with nozzles configured to discharge the liquid droplets, and the common channel includes a supply port configured to introduce the liquid from outside, and a discharge port configured to discharge the introduced liquid outside, and wherein the liquid container tank includes a container configured to contain the liquid to be supplied to the head and including an upstream chamber and a downstream chamber separated via a filtering member, a supply path configured to supply the liquid from the downstream chamber of the container to the supply port of the head, a discharge path configured to discharge the liquid discharged from the discharge port of the head, a first communication path via which the downstream chamber communicates with the discharge path, and a second communication path via which the upstream chamber communicates with the discharge path, wherein a fluid resistance of the second communication path is higher than a fluid resistance of the first communication path.

2. The liquid discharge head unit as claimed in claim 1, wherein one of a non-return valve and the filtering member is provided between a first communicating section of the discharge path communicating with the first communication path and a second communicating section of the discharge path communicating with the second communication path.

3. The liquid discharge head unit as claimed in claim 1, wherein the second communication path partially includes a small cross sectional configuration perpendicular to a fluid flow direction of the liquid.

4. The liquid discharge head unit as claimed in claim 1, wherein the second communication path has a longer channel than that of the first communication path.

5. The liquid discharge head unit as claimed in claim 1, wherein the filtering member is arranged along a direction toward which the head discharges the liquid droplets.

6. The liquid discharge head unit as claimed in claim 1, wherein the liquid container tank further includes output port to discharge the liquid discharged from the discharge port of the head to outside of the liquid discharge head unit, and wherein one end of the discharge path is connected to the discharge port of the head and is not connected to the supply port of the head, and the other end of the discharge path is connected to the output port of the liquid container tank to discharge the liquid discharged from the discharge port of the head to outside of the liquid discharge head unit.

7. The liquid discharge head unit as claimed in claim 1, wherein the first communication path directly connects the upstream chamber to the discharge path in a lateral direction from one side of the container of the liquid container tank to the other side of the container of the liquid container tank.

8. The liquid discharge head unit as claimed in claim 1, wherein the second communication path is disposed above the first communication path and directly connects the downstream chamber to the discharge path in a lateral direction from one side of the container of the liquid container tank to the other side of the container of the liquid container tank.

9. An image forming apparatus comprising the liquid discharge head unit as claimed in claim 1.

10. The image forming apparatus as claimed in claim 9, wherein the liquid container tank further includes an output port to discharge the liquid discharged from the discharge port of the head to outside of the liquid discharge head unit, and wherein one end of the discharge path is connected to the discharge port of the head and is not connected to the supply port of the head, and the other end of the discharge path is connected to the output port of the liquid container tank to discharge the liquid discharged from the discharge port of the head to outside of the liquid discharge head unit.

11. The image forming apparatus as claimed in claim 9, wherein the first communication path directly connects the upstream chamber to the discharge path in a lateral direction from one side of the container of the liquid container tank to the other side of the container of the liquid container tank.

12. The image forming apparatus as claimed in claim 9, wherein the second communication path is disposed above the first communication path and directly connects the downstream chamber to the discharge path in a lateral direction from one side of the container of the liquid container tank to the other side of the container of the liquid container tank.

* * * * *